US010249975B2

(12) United States Patent
Dombrowski et al.

(10) Patent No.: US 10,249,975 B2
(45) Date of Patent: Apr. 2, 2019

(54) INVERTIBLE NUMBERING SCHEME FOR HERMAPHRODITIC CONNECTOR

(71) Applicant: J.S.T. CORPORATION, Farmington Hills, MI (US)

(72) Inventors: Ryan Dombrowski, Ann Arbor, MI (US); Franklin A. Holub, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 15/673,689

(22) Filed: Aug. 10, 2017

(65) Prior Publication Data

US 2019/0052010 A1 Feb. 14, 2019

(51) Int. Cl.
*H01R 13/64* (2006.01)
*H01R 13/46* (2006.01)
*H01R 24/84* (2011.01)

(52) U.S. Cl.
CPC ..... *H01R 13/465* (2013.01); *H01R 13/64* (2013.01); *H01R 24/84* (2013.01)

(58) Field of Classification Search
CPC ..... H01R 24/84; H01R 13/28; H01R 12/716; H01R 13/514; H01R 12/73; H01R 2107/00; H01R 13/405; H01R 13/518; H01R 13/6587; H01R 12/57; H01R 12/721; H01R 12/732; H01R 12/737; H01R 13/005
See application file for complete search history.

(56) References Cited

U.S. PATENT DOCUMENTS 3,086,188 A * 4/1963 Ross ..... H01R 13/28 439/291
3,977,748 A * 8/1976 Gruhn ..... H01R 13/193 439/342
4,449,784 A * 5/1984 Basov ..... G02B 6/3817 385/136

(Continued)

FOREIGN PATENT DOCUMENTS

EP 0 418 782 A2 3/1991

OTHER PUBLICATIONS

SAE/USCAR-12 Revision 4; "Electrical Connector Design Criteria"; SAE International; Issued Jul. 1999; pp. 1-15.

(Continued)

*Primary Examiner* — Truc Nguyen
(74) *Attorney, Agent, or Firm* — Kratz, Quintos & Hanson, LLP

(57) ABSTRACT

A numbering scheme for the cavities of a hermaphroditic connector includes indicia on the rear wall of the connector having one or more horizontal rows (n), each row having the same number of cavities (m). A first indicium on the rear face of the rear wall near the cavity at the upper left in a first orientation of the rear wall has an inverted numeral corresponding to the value of ((m)×(n−1)+1)) adjacent to the upright numeral "1." A second indicium on the rear face of said rear wall near the cavity at the upper right in the first orientation of the rear wall has an upright numeral corresponding to the value of m adjacent to the inverted numeral corresponding to the total number of cavities, which has value m×n. The other cavities may also have indicia following this. The indicia may also contain non-numerical symbols.

11 Claims, 5 Drawing Sheets

(56) References Cited

U.S. PATENT DOCUMENTS

| | | | | |
|---|---|---|---|---|
| 6,302,745 | B1 * | 10/2001 | Landis | H01R 13/6453 439/681 |
| 6,347,715 | B1 * | 2/2002 | Drozdenko | H01R 9/18 211/26 |
| 6,435,891 | B1 * | 8/2002 | Beck, Jr. | H01R 13/6315 439/248 |
| 7,333,391 | B2 * | 2/2008 | Chamberlain | G01V 1/201 367/20 |
| 2002/0168901 | A1 | 11/2002 | Choumach | |
| 2006/0178029 | A1 | 8/2006 | Fabian | |
| 2007/0099480 | A1 * | 5/2007 | Fabian | H01R 13/4367 439/441 |
| 2009/0305570 | A1 * | 12/2009 | Farole | H01R 13/6581 439/660 |
| 2013/0085402 | A1 * | 4/2013 | Callahan | A61B 5/0402 600/509 |
| 2014/0227625 | A1 * | 8/2014 | Karmazyn | H01M 8/242 429/482 |
| 2017/0207563 | A1 | 7/2017 | Dombrowski | |
| 2017/0207573 | A1 | 7/2017 | Dombrowski | |
| 2017/0207590 | A1 | 7/2017 | Dombrowski | |

OTHER PUBLICATIONS

SAE/USCAR-12 Revision 5; "Electrical Connector Design Criteria"; SAE International; Issued Sep. 1999; pp. 1-19 and 2 cover sheets (21 pages total).

* cited by examiner

INVERTIBLE NUMBERING SCHEME FOR HERMAPHRODITIC CONNECTOR

STATEMENT REGARDING FEDERALLY SPONSORED RESEARCH OR DEVELOPMENT

None

THE NAMES OF PARTIES TO A JOINT RESEARCH AGREEMENT

None

STATEMENT REGARDING PRIOR DISCLOSURES BY THE INVENTOR OR A JOINT INVENTOR

None

BACKGROUND OF THE INVENTION

Field of the Invention

The present invention generally relates to the field of electrical connectors, in particular, hermaphroditic connectors, which are useful in automotive applications.

Description of the Related Art

Hermaphroditic (genderless) electrical connectors are connectors of a structure such that two identical connectors can mate to each other. These connectors typically connect a plurality of circuits.

Automotive connectors are typically used in wire harness or cable assemblies. Creating a wire harness is a complex task that usually requires a human operator to execute. Typically, jigboards are used to make the wire harness manufacturing process easier and more consistent between operators. As part of the manufacturing process, an operator must install a specific set of terminals into the appropriate positions of a connector, to populate the connector.

Automotive connectors typically have numbering schemes on a surface of the connector to identify the connector and/or the circuits of the connector. Numbering schemes are difficult for hermaphroditic connectors, since each connector of a mating pair is identical and one of the mating pair must be rotated relative to the other to align the connectors for mating. Therefore, the arrangement of the circuits on the two members of the pair could be confusing to the operator without proper labeling.

An example of an existing standard scheme for cavity numbering in electrical connectors is found in the SAE (Society of Automotive Engineers) Standard USCAR-12-4, published Feb. 12, 2016, section 5.1 (Cavity Numbering).

BRIEF SUMMARY OF THE INVENTION

In one embodiment, the invention is a hermaphroditic connector having a cavity-numbering scheme, the hermaphroditic connector comprising:

a rear wall having a rectangular rear face, said rear wall having cavities for receiving terminals, said cavities being oriented in one or more horizontal rows, each row having the same number of cavities;

an indicium on the rear face of said rear wall near the cavity at the upper left in a first orientation of the rear wall, said indicium comprising:

an inverted numeral having the value of $((m)\times(n-1)+1))$ adjacent to the upright numeral "1", where m is the number of cavities in a row and n is the number of rows.

The hermaphroditic connector may have a second indicium on the rear face of said rear wall near the cavity at the upper right in the first orientation of the rear wall, said second indicium comprising:

an upright numeral having the value of m adjacent to the inverted numeral having the value of the total number of cavities, which is m×n.

The hermaphroditic connector may have a third indicium on the rear face of said rear wall near the cavity at the lower left in the first orientation of the rear wall, said third indicium corresponding to said first indicium rotated 180° around an axis perpendicular to the rear face; and a fourth indicium on the rear face of said rear wall near the cavity at the lower right in the first orientation of the rear wall, said fourth indicium corresponding to said second indicium rotated 180° around an axis perpendicular to the rear face.

The inverted and upright numerals in the indicium may be adjacent to each other in a left-to-right orientation, or in an above-and-below orientation, and may be separated by a separator symbol. In addition, the hermaphroditic connector may have an orientation indicium that is a symbol that does not have 180° rotational symmetry.

In another embodiment, a hermaphroditic connector comprises:

a rear wall having a rectangular rear face, said rear wall having cavities for receiving terminals, said cavities being oriented in two horizontal rows, each row having the same number of cavities;

a set of indicia on the rear face of said rear wall, one indicium near each of the cavities, wherein:

each cavity in the top row has a unique indicium that contains a non-numerical symbol that does not have 180° rotational symmetry; and the indicium for each cavity in the lower row is the indicium for the cavity in the row above rotated 180° around an axis perpendicular to the rear face.

DETAILED DESCRIPTION OF THE INVENTION

A hermaphroditic connector will typically have a housing with a portion that engages the corresponding mating connector, including a rear wall having terminal cavities for insertion of terminals. The rear wall will have a rear face opposite the portion that engages the mating connector, such that when two of the hermaphroditic connectors are mated, the rear face of each connector faces away from the other connector. The rear wall is generally rectangular in shape, with a horizontal direction defined parallel to the 180° axis of symmetry for the mated connectors (see axis 200 in FIG. 2).

The hermaphroditic connector will have cavities in the rear face for insertion of terminals. These cavities (and terminals) will align with the cavities (and terminals) of the mating connector when the connectors are mated.

The cavities will typically be oriented in one or more horizontal rows, with each row having the same number of cavities.

The numbering scheme of the present invention is used on the rear face of a hermaphroditic connector to identify the terminal cavities for insertion of the terminals.

Figure 1A:
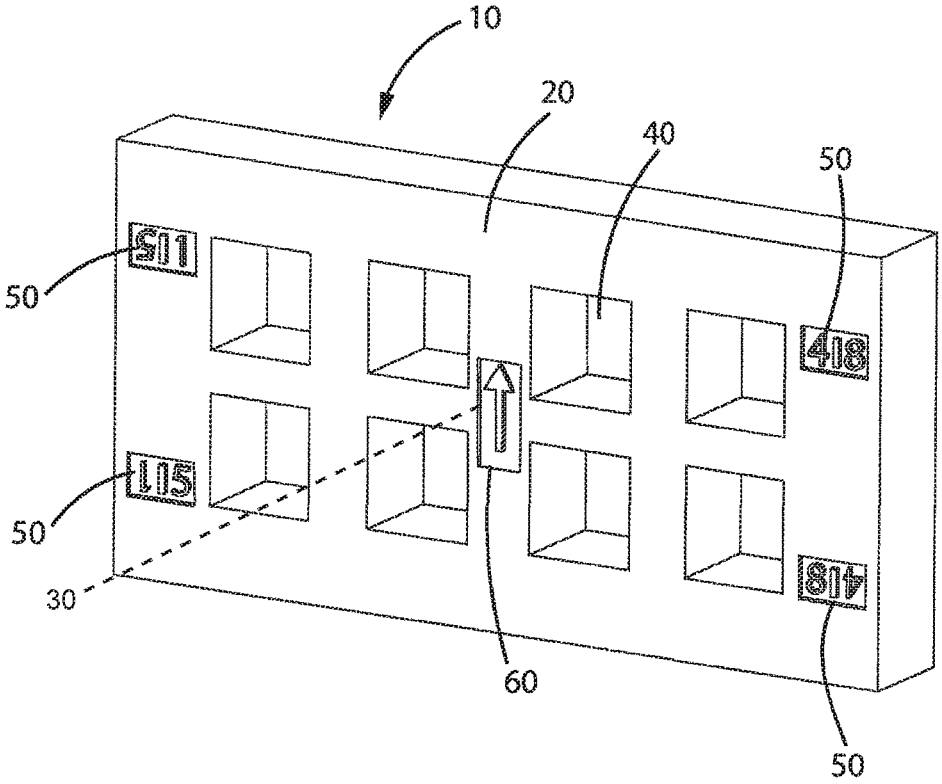
FIG. 1A illustrates a simplified hermaphroditic connector having a numbering scheme of one embodiment of the present invention.
Figure 1B:
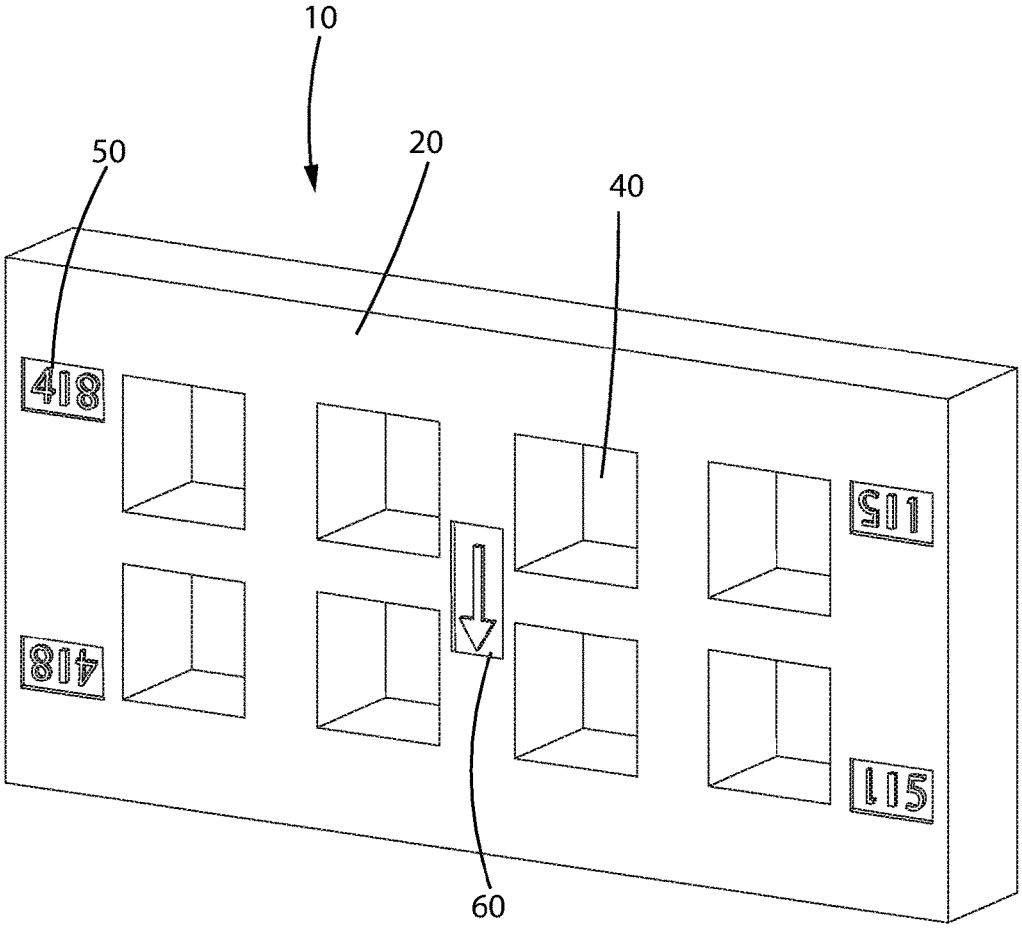
FIG. 1B illustrates the hermaphroditic connector of FIG. 1A rotated 180°.

FIGS. 1A and 1B illustrate a generic hermaphroditic connector with an exemplary numbering scheme of the present invention. FIG. 1B shows the same connector as FIG. 1A, rotated 180° around axis 30, which is perpendicular to the rear face.

For simplicity, in FIG. 1, the generic connector includes only a rear wall 10. A typical connector in actual use would have a variety of other components, including a catch for latching to the corresponding mating connector, but those other components are not necessary for the definition of the numbering scheme of the present invention and for simplicity are not shown in FIGS. 1A and B.

Figure 2:
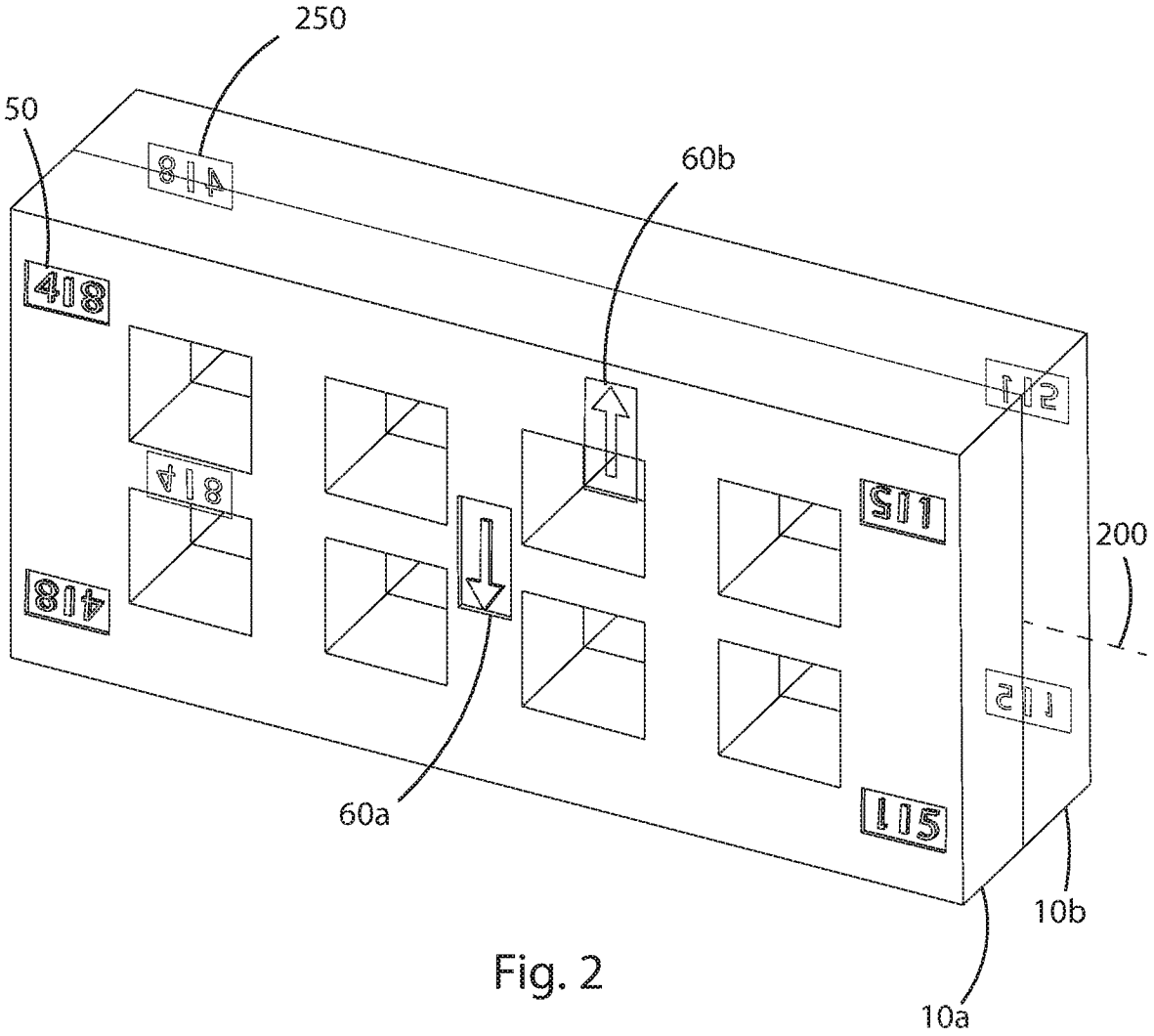
FIG. 2 illustrates two of the hermaphroditic connectors of FIG. 1A mated to form a hermaphroditic connector pair.

FIG. 2 illustrates a mated pair of the hermaphroditic connectors of FIGS. 1A and B. As seen in FIG. 2, the two respective rear walls 10*a*, 10*b* of the pair of connectors are oriented to each other rotated 180° around symmetry axis 200, which is an axis parallel to one edge of the rear wall. This axis direction defines the horizontal direction on the rear face. Therefore, the mated pair of connectors has 180° rotational symmetry around axis 200.

As seen in FIGS. 1A and 1B, the connector has a rear wall 10 with terminal cavities 40 passing through the rear wall. In use, each hermaphroditic connector would have hermaphroditic terminals (not shown) in the terminal cavities, and when the pair of connectors is mated, the corresponding hermaphroditic terminals would be joined to complete the circuit connections through the cavities. In the exemplary case shown in FIG. 1A, there are two rows of four terminal cavities, but other values are possible for the number of rows and the number of terminal cavities per row. In FIG. 1A, the rear walls are shown such that their edges align when mated. However, this is not necessary; it is only necessary that the terminal cavities of the two connectors align when the connectors are mated, such that terminals can be placed in the cavities and a circuit will run through each of these aligned cavities.

The numbering scheme of the present invention is composed of indicia on the rear face 20 of rear wall 10. When two of the connectors are mated, their rear faces 20 face outward, away from where the two connectors meet. Typically, the connector is made of a resin and the numbering scheme will include indicia embossed in the resin or printed on the resin.

It will be understood that there are two possible horizontal orientations of the rear face. In a first orientation, shown in FIG. 1A, the numbering scheme goes from "1" on the upper left to "4" on the upper right. It will be understood that "upper left" and "upper right" are defined with respect to the horizontal orientation. When the hermaphroditic connector of FIG. 1A is rotated. 180° around the axis 30, it appears as in FIG. 1B. In this second orientation, the numbering scheme goes from "4" on the upper left to "1" on the upper right.

The numbering scheme may also have an optional orientation indicium 60. The orientation indicium 60 must be rotationally asymmetric around axis 30; that is, the symbol of the indicium must be different when it is rotated 180° along the axis perpendicular to the rear face of the rear wall, such that the orientation (i.e., first or second orientation) can be determined from looking at the orientation indicium 60. As seen in FIGS. 1A and 1B, the symbol of orientation indicium 60 is an arrow, which is a readily recognizable symbol for identifying "up" and "down." However, the orientation indicium could contain other symbols, such as text or numerals, which could identify the orientation.

Specifically, the numbering scheme shown in FIG. 1A is designed to label the cavities as "1" to "4" across the top row, and then "5" to "8" across the second row. In the embodiment shown in FIG. 1, there are only cavity indicia 50 for four of the eight terminal cavities, in this case placed near the four corners of the rear face. In FIG. 1, each of these cavity indicia 50 is a symbol made up of a numeral (arabic numeral illustrated) and an inverted numeral next to (adjacent to) it (left-to-right), separated by a separator symbol, in this case, a bar. For example, in FIG. 1, the upper left indicium 50 has an inverted "5" to the left of an upright "1," the upper right indicium has an upright "4" to the left of an inverted "8," etc.

The numbering scheme will be understood to be based on 180° rotation of the hermaphroditic connector around axis 200. That is, when the orientation indicium 60 faces upward, the numbering is 1 to 4 left-to-right across the top row and 5 to 8 left-to-right across the bottom row. To align corresponding cavities with the same numerals, when the orientation indicium 60 faces downward, the numbering is 4 to 1 left-to-right across the top row, and 8 to 5 left to right across the bottom row.

Therefore, in FIG. 1A, an inverted "5" is next to an upright "1" at the upper left and an upright "4" is next inverted "8" at the upper right. Similarly, an inverted "1" is next to an upright "5" at the lower right and an inverted "1" is next to an upright "5" at the lower right. In this scheme, the indicium in the upper left therefore corresponds to the indicium in the lower left rotated by 180° around an axis perpendicular to the rear face, and the indicium in the upper right corresponds to the indicium in the lower right rotated by 180° around an axis perpendicular to the rear face.

This scheme is generalizable to any number of rows and number of cavities in a row (i.e., number of columns). In the first orientation, the cavities are typically numbered with number 1 in the upper left corner, progressing to the right, and then continuing on the next row starting at the left, and so on. The total number of cavities is, of course, the number of cavities in a row (m) times the number of rows (n). Therefore, in the first orientation of the hermaphroditic connector, the upper left indicium will typically have the inverted numeral corresponding to the leftmost cavity of the bottom row (which corresponds to $((m)\times(n-1)+1)$) next to the upright numeral "1." The upper right indicium will have the upright numeral corresponding to the number of cavities in a row (m) next to the inverted numeral corresponding to the total number of cavities $((m)\times(n))$. The lower left indicium will correspond to the upper left indicium rotated 180° around an axis perpendicular to the rear face. The lower right indicium will correspond to the upper right indicium rotated 180° around an axis perpendicular to the rear face.

The second orientation, of course, corresponds to the first orientation rotated 180° around the central axis 30.

It is also possible to provide additional indicia over other cavities on the rear wall. These indicia would follow the same numbering scheme.

As noted above, FIG. 2 illustrates a pair of the rear walls 10*a*, 10*b*, of FIG. 1A mated with each other. In FIG. 2, for illustration purposes, the connectors are shown as if transparent, so that the indicia on rear wall 10*b*, which faces away from the viewer of the figure, are illustrated as ghost images 250. As can be seen, when the pair of the hermaphroditic connectors is mated, as shown in FIG. 2, the labeling numerals of the terminal cavities align; that is, upright "1" aligns with upright "1", etc.

As can be seen, the orientation indicium 60 on the rear wall appears rotated 180° in the ghost image. That is, in the front connector orientation indicium 60*a* points downward, and in the rear connector, orientation indicium 60*b* points upward.

The numbering scheme of the present invention is particularly useful when manufacturing a wire harness. This is typically performed by a human operator, with wires installed on a jigboard. The labeled or numbered wires terminate in terminals, and the manufacture process involves inserting the terminals into the appropriate positions in a connector.

Therefore, in use, in an example, a first hermaphroditic connector is placed in the orientation shown in FIG. 1A (first orientation), with the orientation indicium 60*a* guiding the orientation. The first hemaphroditic connector is loaded with terminals corresponding to circuit nos. 1 to 8. These terminals will typically terminate the wires of one bundle of wires.

A second hermaphroditic terminal is placed in orientation shown in FIG. 1B, with the orientation indicium 60*b* guiding the orientation, and it is loaded with the terminals corresponding to circuit nos. 1 to 8 of the counterpart portions of the circuits, typically terminating the wires of another bundle. The orientation indicia 60*a, b* may also serve as guides for correct orientation of the terminals within the terminal cavities, and can guide in the mating of the two connectors. When the two hermaphroditic terminals are mated, the terminals will be properly aligned and connected.

As illustrated in FIGS. 1A, 1B and 2, it is not necessary to provide a cavity indicium for each terminal cavity. In the numbering scheme shown, the indicia would therefore identify cavities/circuits no. 1, 4, 5 and 8. The locations of cavities/circuits no. 2, 3, 6 and 7 would then be apparent to the user, so separately labeling these cavities is not necessary.

At the minimum, the numbering scheme of the present invention requires only one indicium 50. However, the numbering scheme will typically use multiple indicia 50, such as the four indicia 50 shown in FIG. 1A, and will typically use an orientation indicium 60.

Figure 3:
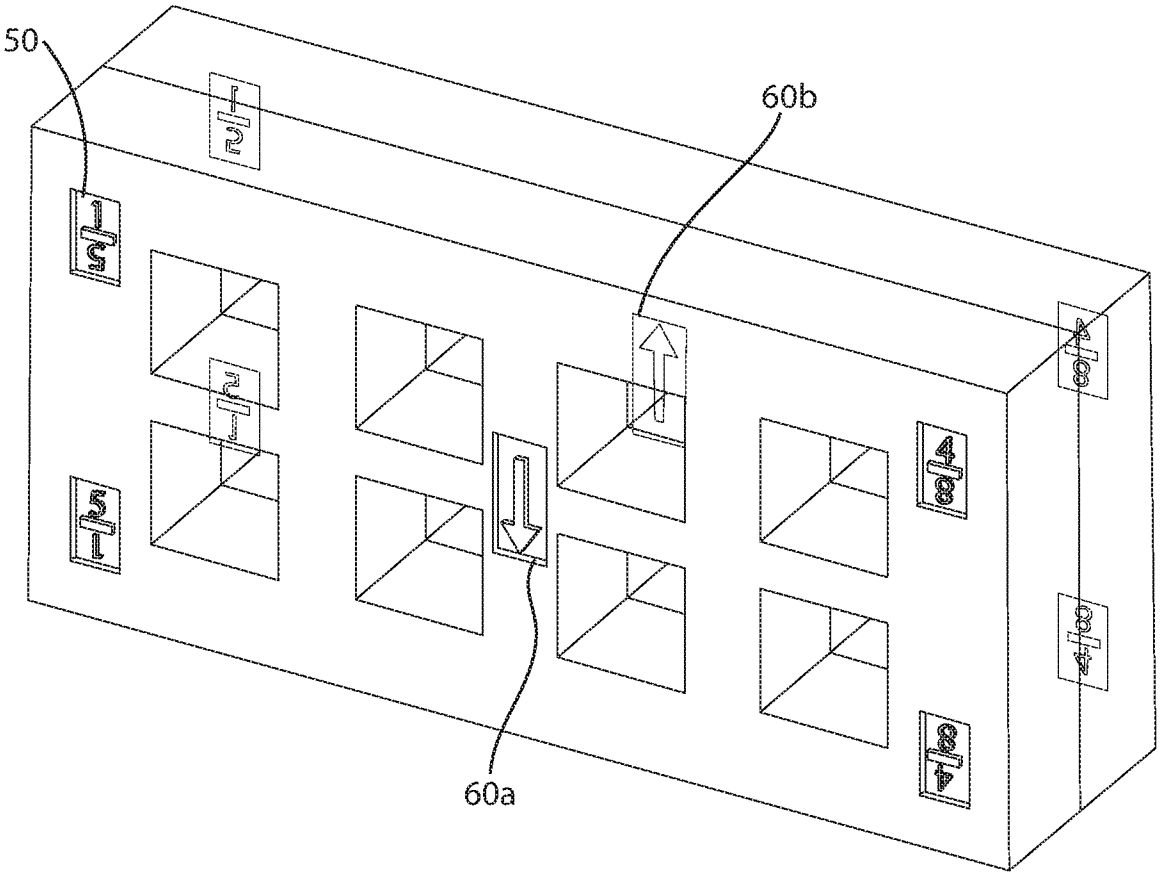
FIG. 3 illustrates a hermaphroditic connector pair according to another embodiment of the invention.

FIG. 3 illustrates a generic hermaphroditic connector pair of another embodiment of the present invention. FIG. 3 is similar to FIG. 2, except that the cavity indicia 50 are made up of a numeral and an inverted numeral below it, separated by a bar, rather than the two numerals being left-to-right of each other. That is, in the embodiment in FIGS. 1A, 1B and 2, the two numerals in the indicium are adjacent to each other left-to-right, while in the embodiment in FIG. 3, the two numerals in the indicium are adjacent to each other above-and-below.

Figure 4:
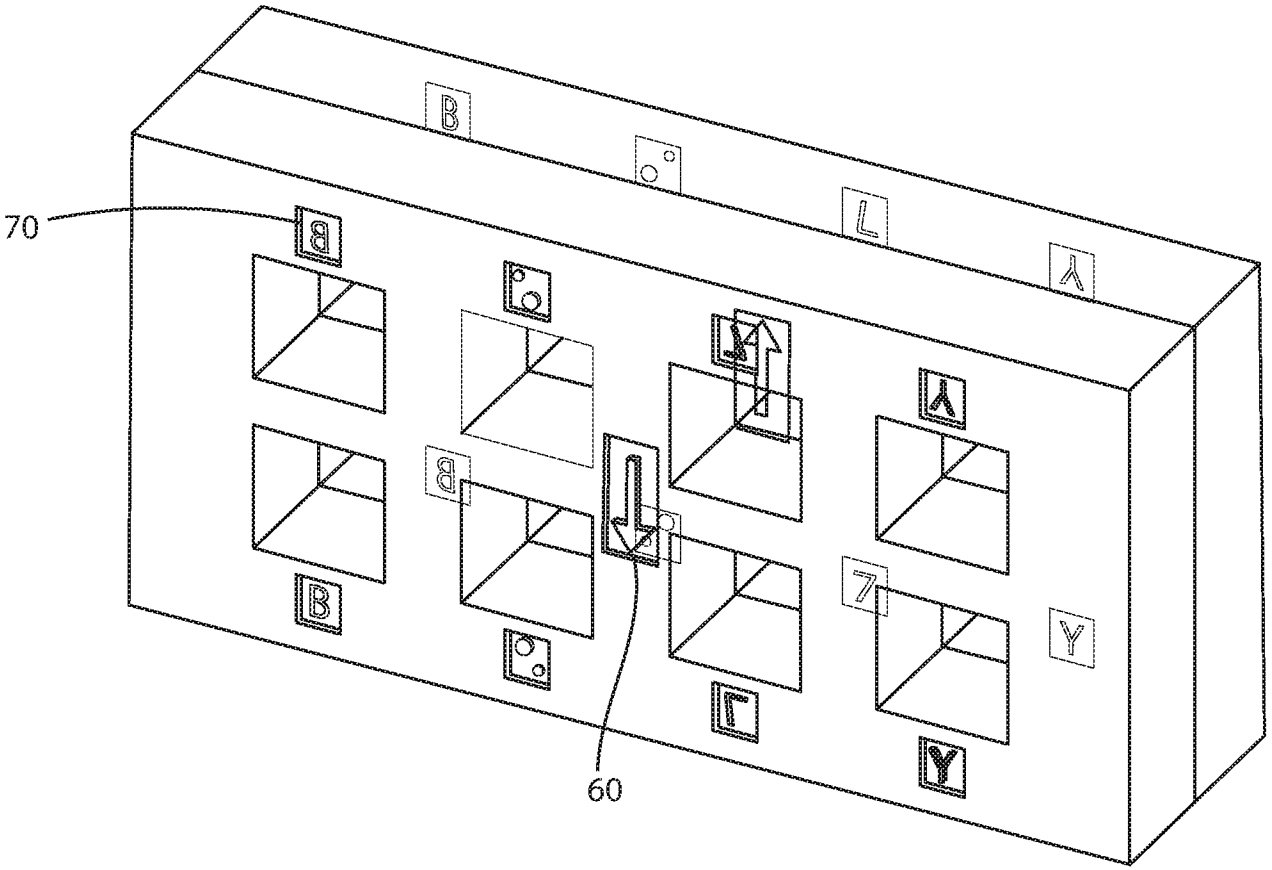
FIG. 4 illustrates a hermaphroditic connector pair according to yet another embodiment of the invention.

FIG. 4 illustrates a generic hermaphroditic connector pair of yet another embodiment of the present invention. In FIG. 4, each of the eight terminal cavities is labeled with an indicium 70 that is a non-numerical symbol. The indicia are paired for the two rows of terminal cavities, such that the symbol in the upper has 180° symmetry with the symbol below it in the lower row. When the connector is in a first orientation (for example, with orientation indicium 60 pointing upwards) each of the indicia 70 will typically be different and unique, thereby uniquely identifying each terminal cavity.

The non-numerical symbols used for the terminal cavity indicia can be non-conventional symbols, as shown, or can be conventional symbols, such as letters.

With this indicia numbering scheme, once the connector is oriented by use of the orientation indicium (arrow), each of the cavities for a particular circuit has a unique symbol for its indicium. In use, each connector of the pair would be loaded with eight (in this example) terminals for eight circuits based on the eight unique symbols, and when the two connectors are mated, the eight terminals on one connector properly align with the eight terminals for the other connector.

LIST OF REFERENCE NUMERALS

10, 10*a*, 10*b* Rear wall
20 Rear face
30 Axis
40 Terminal cavities
50, 70 Cavity indicium
60, 60*a*, 60*b* Orientation indicium
200 Axis
250 Ghost image of cavity indicium

The invention claimed is:

1. A hermaphroditic connector having a cavity-numbering scheme, the hermaphroditic connector comprising:

a rear wall having a rectangular rear face, said rear wall having cavities for receiving terminals, said cavities being oriented in one or more horizontal rows, each row having the same number of cavities;

a first indicium on the rear face of said rear wall near the cavity at the upper left in a first orientation of the rear wall, said first indicium comprising:

an inverted numeral having the value of $((m)\times(n-1)+1))$ adjacent to an upright numeral "1", where m is the number of cavities in a row and n is the number of rows.

2. The hermaphroditic connector of claim 1, further comprising:

a second indicium on the rear face of said rear wall near the cavity at the upper right in the first orientation of the rear wall, said second indicium comprising:

an upright numeral having the value of m adjacent to the inverted numeral having the value of the total number of cavities, which is m×n.

3. The hermaphroditic connector of claim 2, further comprising:

a third indicium on the rear face of said rear wall near the cavity at the lower left in the first orientation of the rear wall, said third indicium corresponding to said first indicium rotated 180° around an axis perpendicular to the rear face; and a fourth indicium on the rear face of said rear wall near the cavity at the lower right in the first orientation of the rear wall, said fourth indicium corresponding to said second indicium rotated 180° around an axis perpendicular to the rear face.

4. The hermaphroditic connector of claim 1, wherein:

the inverted numeral and the upright numeral "1" of the first indicium are adjacent to each other in a left-to-right orientation.

5. The hermaphroditic connector of claim 1, wherein:

the inverted numeral and the upright numeral "1" of the first indicium are adjacent to each other in an above-and-below orientation.

6. The hermaphroditic connector of claim 1, wherein:

the inverted numeral and the upright numeral "1" of the first indicium are separated by a separator symbol.

7. The hermaphroditic connector of claim 6, wherein:

the separator symbol is a bar.

8. The hermaphroditic connector of claim 3, further comprising:

an orientation indicium that is a symbol that does not have 180° rotational symmetry.

9. The hermaphroditic connector of claim 8, wherein:

the orientation indicium is located near the center of the rear face.

10. The hermaphroditic connector of claim 8; wherein:

the orientation indicium is an arrow.

11. A hermaphroditic connector having a cavity-numbering scheme, the hermaphroditic connector comprising:

a rear wall having a rectangular rear face, said rear wall having cavities for receiving terminals, said cavities being oriented in a first horizontal row and a second horizontal row, each row having the same number of cavities;

a set of indicia on the rear face of said rear wall, one indicium near each of the cavities, wherein:

each cavity in the first horizontal row has a unique indicium that contains a non-numerical symbol that does not have 180° rotational symmetry; and the indicium for each cavity in the second horizontal row is the indicium for the adjacent cavity in the first horizontal row rotated 180° around an axis perpendicular to the rear face.

* * * * *